US005559849A

United States Patent [19]

Bruijns

[11] Patent Number: 5,559,849

[45] Date of Patent: Sep. 24, 1996

[54] X-RAY DEVICE

[75] Inventor: Antonius J. C. Bruijns, Eindhoven, Netherlands

[73] Assignee: U.S. Philips Corporation, New York, N.Y.

[21] Appl. No.: 405,061

[22] Filed: Mar. 16, 1995

[30] Foreign Application Priority Data

Mar. 17, 1994 [EP] European Pat. Off. ..... 94200686

[51] Int. Cl.[6] ..... H05G 1/64

[52] U.S. Cl. ..... 378/98.2; 378/98; 378/98.8

[58] Field of Search ..... 378/98, 98.2, 98.3, 378/98.7, 98.11, 98.8, 98.12, 62, 96, 99; 358/111

[56] References Cited

U.S. PATENT DOCUMENTS 4,355,331 10/1982 Georges et al. ..... 378/98.3

FOREIGN PATENT DOCUMENTS

| | | |
|---|---|---|
| 0052995 | 6/1982 | European Pat. Off. . |
| 0562657A3 | 9/1993 | European Pat. Off. . |
| 0562657A2 | 9/1993 | European Pat. Off. . |
| 3315882 | 11/1984 | Germany . |
| 3831180 | 4/1989 | Germany . |

*Primary Examiner*—Don Wong
*Attorney, Agent, or Firm*—Jack D. Slobod

[57] ABSTRACT

An X-ray device comprising an image pick-up system with at least two image sensors (11 and 12) and a control circuit (41) arranged so that the image sensors are not simultaneously but alternately sensitized in the cine mode. This arrangement enables the number of object images picked up per second to be increased in comparison with a similar system in which the sensors are simultaneously sensitized. When CCD sensors are used, the control circuit can also be arranged so that the integration time of the sensors becomes adjustable. These two steps reduce motion artefacts in images of quickly moving objects, for example images of a moving heart.

10 Claims, 4 Drawing Sheets

X-RAY DEVICE

BACKGROUND OF THE INVENTION

1. Field of the Invention

The invention relates to an X-ray device, comprising an X-ray tube and an image intensifier/pick-up chain, including an X-ray image intensifier, an image pickup system with a first and a second image sensor, an image processing system, and an optical beam splitter which is arranged between the image intensifier and the image pick-up system in order to image an exit screen of the image intensifier on the image sensors.

2. Description of the Related Art

An X-ray device of this kind is known from DE A 33 15 883.

An X-ray device disclosed in the cited Patent Application is used to form images of an object, for example a patient, present between the X-ray source and the image intensifier/pick-up chain. An optical beam splitter is used to enhance the spatial resolution. This optical beam splitter images an exit screen of the image intensifier on two or more image sensors.

The number of images picked up by means of the image sensors in an X-ray system is dependent inter alia on the exposure time, the integration time, the readout time and the image processing system used. The exposure time is determined by the absorption within the patient and by the desired signal-to-noise ratio of the image. The integration time is determined by the conversion of the optical image into an electric charge by the sensor and is dependent on the sensitivity of the sensor and the amount of light from the image intensifier. The read-out time is determined by the reading of the electronic information of the sensor, for example a CCD sensor or Vidicon, for supply to an image processing system. The minimum read-out time for an image sensor of given technology is fixed. The maximum number of images to be picked up per second is determined by this minimum read-out time, and hence also the rate at which an image processing system connected thereto can process these images.

The main drawback of the known device consists in the inherent limitation of the pick-up speed, because the maximum number of images that can be picked up by a sensor per second is limited. A second drawback consists in that motion artefacts occur in the image when quickly moving objects are picked up.

SUMMARY OF THE INVENTION

It is inter alia an object of the invention to increase the number of images per second for the pick-up system and to reduce the motion artefacts in the image while utilizing existing sensors, without modifications and expensive changes of the sensors being necessary.

To achieve this, an X-ray device of the kind set forth in accordance with the invention is characterized in that the image pick-up system comprises a control circuit for alternately sensitizing one of the image sensors for the picking up of image information. The number of images per second, and hence the temporal resolution, can be increased by alternately sensitizing rendering the image sensors. Increasing the number of images per second is advantageous for given angio applications, for example imaging of a moving heart; this is known as the cine mode. A difference with respect to the known device consists in that in accordance with the invention the plurality of sensors are not used to increase the spatial resolution but the temporal resolution.

A special embodiment of an X-ray device in accordance with the invention is characterized in that the image sensors are grid-type sensors which are read out in parallel lines, the image sensors being arranged relative to the beam splitter in such a manner that the points of an exit screen which are imaged between the grid lines of the first sensor are imaged on the grid lines of the second sensor. As a result of this step, in comparison with a prior-art pick-up system the spatial resolution is not reduced in the event of imaging of stationary or slowly moving objects.

A next embodiment of an X-ray device in accordance with the invention is characterized in that the image sensors are CCD sensors and that the control unit is arranged so that the image pick-up time of the sensor is adjustable. CCD sensors are capable of influencing the integration time via electronic control. When short integration times are used, the motional unsharpness is reduced, regardless of the read-out time used by the CCD sensor or the pick-up system used. The required higher light intensity on the sensor is not objectionable, because this higher light intensity is not produced by a higher X-ray dose. In the cine mode of existing systems the light intensity of the light beam from the image intensifier already suffices to compensate for the shorter integration time of the sensor. In existing systems the amount of light for the image sensor, desired for a given contrast, is reduced by beam stopping. Systems in which the invention is used require less beam stopping and the light present is then used to improve the diagnostic quality of the images.

The use of CCD sensors also enables temporary storage of the images in the image memory of the CCD sensor, so that the image information stored can subsequently be transferred to the image processing system. Another advantage is that CCD sensors occupy little space and allow for a compact construction of the camera system.

A next embodiment of an X-ray device in accordance with the invention is characterized in that the image pick-up system is arranged to supply an image signal for an image processing system in which an image is displayed by means of two fields. This step enables interlaced scanning as is customary in video systems.

A further embodiment of an X-ray device in accordance with the invention is characterized in that the image information of the first sensor is used for the first field of the image and the image information of the second sensor is used for the second field of the image. As a result of this step, the information of moving images is chronologically correctly displayed on the display screen. Moreover, the lines of the second field then appear between the lines of the first field in the correct sequence. In the case of slow movements, this automatically implies an increase of the spatial resolution in comparison with the use of only one sensor. The invention will be described in detail hereinafter, by way of example, with reference to drawing.

BRIEF DESCRIPTION OF THE DRAWING

The drawing comprises the following Figures:

FIG. 1 shows diagrammatically an embodiment of an X-ray device in which the invention is used. The X-ray source 1 generates an X-ray beam 3 which is applied to an object 2, for example a patient to be examined. Absorption of the X-ray beam in the object forms an X-ray shadow image on the entrance window 4 of an X-ray image intensifier tube 5. The X-ray image intensifier tube 5 converts the X-ray image formed on its entrance screen into an image of light of wavelengths in the visible range on its exit window 6. The exit screen 6 is imaged onto two image sensors 11 and 12 by means of an optical system which consists of an imaging system which is in this case shown as a single lens 8, a diaphragm 10 and a beam splitter 21. The optical system may also have a construction other than the construction shown and comprise an imaging system which is composed, for example of a diaphragm and several lenses which, for example may also be arranged partly between the beam splitter and the sensors. The image information of the sensors 11 and 12 is processed by an image processing system 13 and, for example, stored in a memory system 15, for example an optical or magnetic disc or a semiconductor memory, and possibly printed by a printer 16 or displayed on a monitor 14. The image processing system 13 will be described in detail with reference to FIG. 3.

Figure 1:
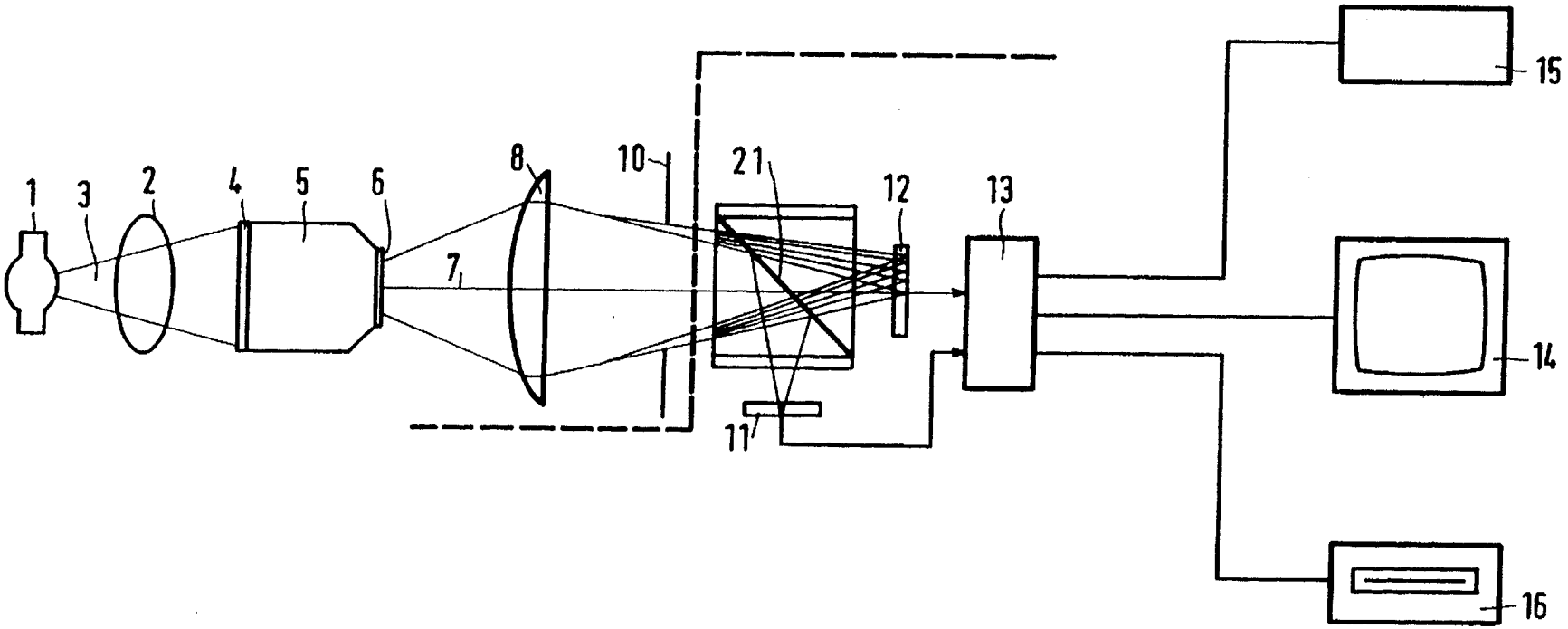
FIG. 1 shows diagrammatically a first embodiment of an X-ray device in which the invention is used.

The described embodiment of the X-ray device can be used, for example in three modes: the fluoroscopy mode, the exposure mode and the cine mode. In the fluoroscopy mode the object is continuously exposed to an X-ray beam whose intensity just suffices to form an X-ray image intensifier image of an acceptable noise level. During the exposure period in the exposure mode the object is exposed, to an X-ray beam of an intensity which is, for example 100 or more times higher than the intensity in the fluoroscopy mode, and images of the object are made at a rate of, for example six images per second. During the exposure period in the cine mode the object is exposed to an X-ray beam of an intensity which is, for example ten times higher than the intensity used in the fluoroscopy mode, and images of the object are made at a rate of, for example 100 images per second.

The invention relates notably to the formation of images in the cine mode. In the described embodiment the image sensors 11 and 12 used are, for example grid-type sensors such as a Charge Coupled Device sensor or a Vidicon, read out in parallel lines, the image sensors being arranged relative to the beam splitter 21 in such a manner that those points of the exit screen of the image intensifier 5 which are imaged between the grid lines of the sensor 11 are imaged on the grid lines of the sensor 12.

An existing system comprising commercially available CCD sensors cannot achieve a pick-up rate of 100 images per second. The system in accordance with the invention can achieve a pick-up rate of 100 images per second in the cine mode in that signals are generated by controlling the image processing system 13 such that the sensors 11 and 12 are alternately sensitized and read out. These signals will be described with reference to FIG. 4. The use of the invention doubles the number of images per second in comparison with control whereby both sensors are simultaneously sensitized. The spatial resolution is thus affected, but remains acceptable in the cine mode if image sensors having a sufficiently high resolution are used, and the maximum spatial resolution is available in the exposure mode. In the case of stationary objects, the maximum resolution is also available in the cine mode.

Any loss of contrast in the image picked up, due to a shorter integration time, is prevented by enlarging the diaphragm 10 in the optical system, because sufficient light is present from the image intensifier in the cine mode.

Figure 2:
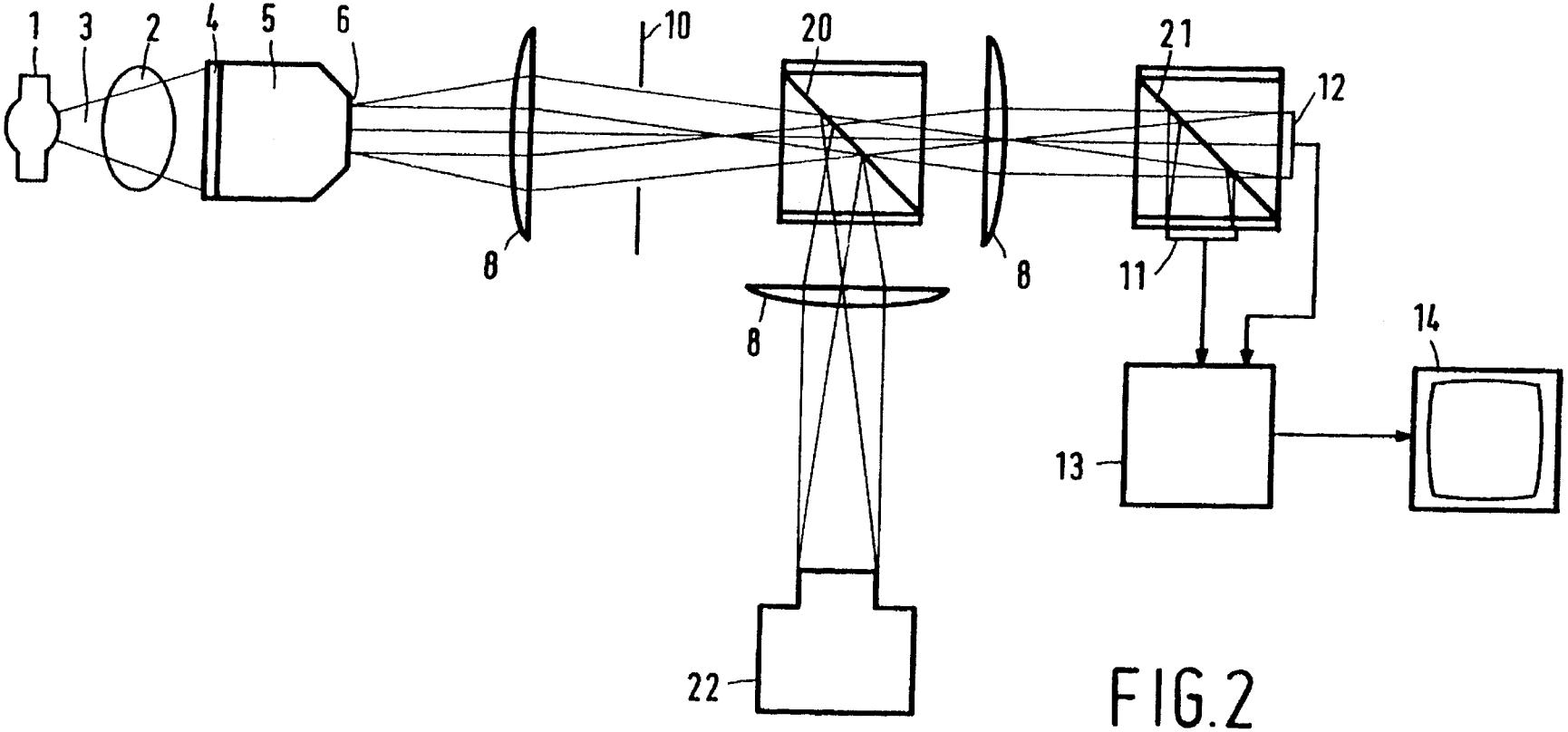
FIG. 2 shows diagrammatically a second embodiment of an X-ray device in which the invention is used.

FIG. 2 shows a second embodiment of an X-ray device in which the invention is used. Elements which are similar to those shown in FIG. 1 are denoted by the same reference numerals and will not be described in detail again. The embodiment shown in FIG. 1 is extended with a second beam splitter 20 and a cine camera 22. The beam splitter 20 on the one hand images the exit screen 6 on a cine camera 22 and on the other hand on the beam splitter 21. The cine camera records the image on a film.

Figure 3:
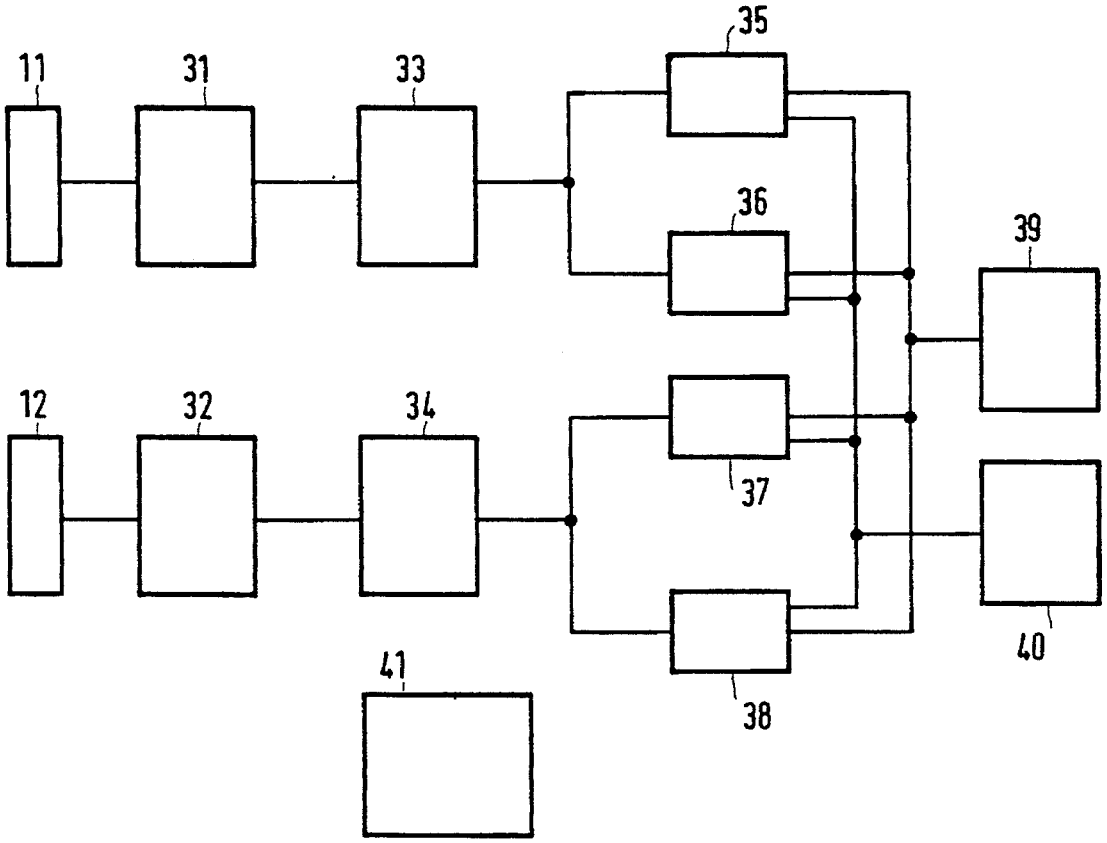
FIG. 3 shows diagrammatically an image processing system with a control circuit of an X-ray device.

FIG. 3 shows diagrammatically an embodiment of the image processing system and a control circuit for two image sensors. The following functions are executed by the image processing system. The electronic image signals of the image sensors 11 and 12 are processed in the preprocessors 31 and 32, respectively, after which they are converted into digital information by the analog-to-digital converters 33 and 34 and stored in one of the four image memories 35, 36, 37 and 38. Subsequently, the digital-to-analog converter 39 converts the digital information from one of the memories into analog signals which can be displayed on a monitor. A digital buffer 40, comprising a multiplex device, can connect the image memories 35, 36, 37, 38 at option to other memory systems, for example an optical or magnetic disc unit, or a digital printer whereby the information from the image memories 35, 36, 37, 38 can be recorded as images on paper or film. It is also possible, for example, to arrange the system 13 so that the image information is displayed on the monitor 14 in slow motion or as a stationary image.

In accordance with the invention, in the "cine" mode the control system 41 generates signals whereby the sensors 11 and 12 are alternately sensitized and read out. Subsequently, the information is transferred to one of the image memories 35, 36, 37 and 38. The signals are generated as described with reference to FIG. 4.

In an embodiment as shown in FIG. 3 the sensors used are appropriate CCD sensors, for example Philips FT12 CCD sensors. Generally speaking, CCD sensors comprise a photosensitive section and a memory section which are provided on one semiconductor substrate. The CCD image sensors of the present embodiment are of the "frame-transfer" type. This means that the number of pixels in the photosensitive section equals the number of pixels in the memory section. In the photosensitive section of this sensor photosensitive elements are arranged in a matrix of, for example 512 rows and 1024 columns, and in the memory section memory elements are arranged in a matrix of again 512 rows and 1024 columns. The charge image generated by photons in the photosensitive section is stored in this memory before being read out. The image sensors 11 and 12 are controlled by the control circuit 41 by way of the following signals:

- clear signals CLR1 and CLR2 whereby the electric charge generated by the photons is dissipated. In the absence of this signal the charge generated by the photons is accumulated.
- vertical transport signals VT1 and VT2 whereby the charge image generated by photons is stored in a memory provided in the image sensor, and
- read sensor signals RS1 and RS2 whereby the information stored in the memory of the image sensor is read-out so as to be applied to one of the image memories 35, 36, 37 and 38.

The image information of the sensors is stored in the image memories 35, 36, 37 and 38. For example, time compression is also performed by means of these image memories and the control circuit 41. Time compression reduces the time during which information is read from an image memory relative to the time during which the information has been written into the memory. In the described application time compression is used to convert the information of the 512 lines in a field of 20 ms to a field of 512 lines of 10 ms. The image memories are controlled by the control circuit 41 by way of the following signals:

write memory signals WM1, WM2, WM3 and WM4 whereby one of the image memories 35, 36, 37 and 38 is selected for storage of the image information of the sensor 11 or 12, and read memory signals RM1, RM2, RM3 and RM4 whereby one of the image memories 35, 36, 37 and 38 is selected so as to read out the image information of one field which is rendered suitable for the video system used, for example by way of time compression.

The control circuit 41 also supplies the clock signals required by the sensors 11 and 12 and the image memories 35, 36, 37 and 38. The horizontal and vertical synchronization signals for the monitor are also generated by the control circuit.

The video system utilized in the present application has a frame frequency of 100 Hz. Each frame is composed of two fields of 512 lines which are interlaced. Other video systems are also feasible, for example video systems with a frame frequency of 50 Hz and a frame which is composed of two interlaced fields of 625 lines, video systems with a frame frequency of 60 Hz and a frame composed of two interlaced fields of 512 lines, or video systems with a frame frequency of 70 Hz and a non-interlaced field of 480 lines without interlacing. Flicker-free display systems are also feasible, for example with a frame frequency of 76 Hz and 1024 lines without interlacing.

Figure 4:
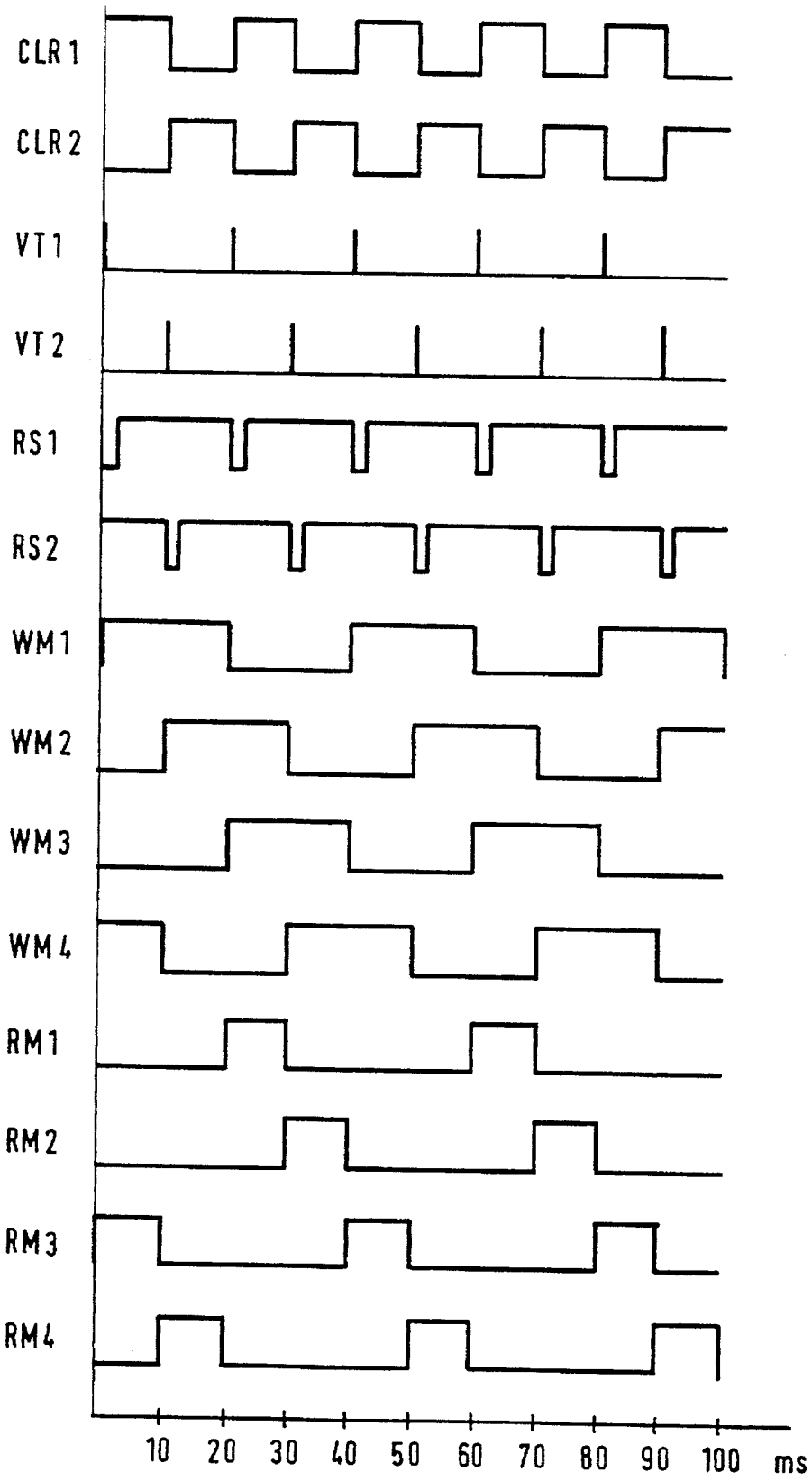
FIG. 4 shows diagrammatically the control signals applied to the two image sensors and image memories.

FIG. 4 shows diagrammatically the sequence and the duration of the signals according to the invention as generated by the control circuit 41 in order to sensitize and read out the sensors 11 and 12 in an alternating fashion and to achieve time compression for a video system with a frame frequency of 100 Hz and 512 lines per field. The signals CLR1 and CLR2 alternately have the value Vhigh and Vlow. In the cine mode it does not occur that CLR1 and CLR2 simultaneously have the value Vlow. For as long as CLR1 or CLR2 has the value Vhigh, the charge generated in the photosensitive section of the sensor is dissipated. The integration time of the sensor is determined by the time during which the signals CLR1 and CLR2 have the value Vlow. When the desired integration time is reached, the charge images built up are transported to the memory of the sensor during the pulses VT1 and VT2. Subsequently, the information of the sensor selected by RS1 or RS2 is transferred to one of the memories, selected by means of the signals WM1, WM2, WM3 and WM4. For display on a monitor, the image information is read from one of the four memories 35, 36, 37 or 38 to be selected by means of the signals RM1, RM2, RM3 and RM4, respectively.

I claim:

1. An X-ray device for producing X-ray images in cine mode, comprising an X-ray tube and an image intensifier/pick-up chain, including an X-ray image intensifier, an image pick-up system with at least a first and a second image sensor, an image processing system, and an optical beam splitter which is arranged between the image intensifier and the image pick-up system in order to image an exit screen of the image intensifier on the image sensors, characterized in that the image pick-up system comprises a control circuit for alternatively sensitizing the image sensors to receive successive fields of image information at alternative image sensors and for interleaving the fields of image information received by the image sensors to produce X-ray images in cine mode at an image field rate higher than the image field rate at which each one of the image sensors is receiving image information.

2. An X-ray device, comprising an X-ray tube and an image intensifier/pick-up chain, including an X-ray image intensifier, an image pick-up system with a first and a second image sensor, an image processing system, and an optical beam splitter which is arranged between the image intensifier and the image pick-up system in order to image an exit screen of the image intensifier on the image sensors, characterized in that the image pick-up system comprises a control circuit for alternately sensitizing one of the image sensors for the picking-up of image information and in that the image sensors are grid-type sensors which are read out in parallel lines, the image sensors being arranged relative to the beam splitter in such a manner that the points of an exit screen which are imaged between the grid lines of the first sensor are imaged on the grid lines of the second sensor.

3. A device as claimed in claim 1, characterized in that the image sensors are CCD sensors and that the control unit is arranged so that the image pick-up time of the sensor is adjustable.

4. A device as claimed in claim 3, characterized in that the image pick-up system is arranged to supply an image signal for an image processing system in which an image is displayed by means of two fields.

5. A device as claimed in claim 4, characterized in that the image information of the first sensor is used for the first field of the image and the image information of the second sensor is used for the second field of the image.

6. A device as claimed in claim 2, characterized in that the image sensors are CCD sensors and that the control unit is arranged so that the image pick-up time of the sensor is adjustable.

7. A device as claimed in claim 6, characterized in that the image pick-up system is arranged to supply an image signal for an image processing system in which an image is displayed by means of two fields.

8. A device as claimed in claim 7, characterized in that the image information of the first sensor is used for the first field of the image and the image information of the second sensor is used for the second field of the image.

9. An X-ray device as claimed in claim 1 wherein the energy of the X-ray beam produced by the X-ray device remains constant for said successive fields of image information.

10. An X-ray device as claimed in claim 1 wherein each frame of the X-ray images includes a field of image information received by said first image sensor and an interleaved field of image information received by said second image sensor.

* * * * *